US006660220B2

(12) United States Patent
Forman

(10) Patent No.: US 6,660,220 B2
(45) Date of Patent: Dec. 9, 2003

(54) APPARATUS AND METHOD FOR DELIVERING AN INERT GAS TO PREVENT PLUGGING IN A SLIDE GATE

(75) Inventor: Bruce R. Forman, Bethlehem, PA (US)

(73) Assignee: ISG Technologies Inc., Richfield, OH (US)

( * ) Notice: Subject to any disclaimer, the term of this patent is extended or adjusted under 35 U.S.C. 154(b) by 22 days.

(21) Appl. No.: 10/029,897

(22) Filed: Dec. 21, 2001

(65) Prior Publication Data

US 2003/0116893 A1 Jun. 26, 2003

(51) Int. Cl.[7] ..... B22D 41/08

(52) U.S. Cl. ..... 266/45; 266/80; 222/590; 222/603

(58) Field of Search ..... 222/590, 591, 222/600, 603; 266/45, 78, 80

(56) References Cited

U.S. PATENT DOCUMENTS

| | | | |
|---|---|---|---|
| 3,253,307 A | 5/1966 | Griffiths et al. | |
| 3,918,613 A | 11/1975 | Shapiand, Jr. | |
| 4,202,533 A | 5/1980 | Daussan et al. | |
| 4,219,188 A | 8/1980 | Meier | |
| 4,555,094 A | 11/1985 | Evertz et al. | |
| 4,708,327 A | 11/1987 | Waltenspuhl | |
| 4,799,649 A | 1/1989 | King | |
| 4,909,422 A | 3/1990 | Muller | |
| 5,019,159 A | 5/1991 | Muller et al. | |
| 5,119,976 A | 6/1992 | Muller | |
| 5,167,902 A | 12/1992 | McCray et al. | |
| 5,173,242 A | 12/1992 | Luhrsen et al. | |
| 5,284,278 A | 2/1994 | Waltenspuhl | |
| 5,431,374 A | 7/1995 | Janssen et al. | |
| 5,967,220 A | 10/1999 | Lauener | |
| 6,213,193 B1 | 4/2001 | Lauener | |
| 6,250,521 B1 * | 6/2001 | Assar | 222/590 |

* cited by examiner

*Primary Examiner*—Scott Kastler
(74) *Attorney, Agent, or Firm*—Harold I. Masteller, Jr.

(57) ABSTRACT

The invention is directed to a dynamic control system that maintains an inert gas feed at a constant target gas flow rate sufficient to prevent or reduce alumina or alloy plugging within a slide gate discharge opening. The dynamic control system includes a gas feed line extending between an inert gas supply and the slide gate discharge passageway, a gas flow regulator, a pressure gauge; and a gas feed flow control that detects an amount of incoming inert gas lost through leaks in the system and adjusts the gas flow regulator in response to the detected amount of incoming gas flow loss so that the adjusted incoming gas feed continues to deliver the target inert gas flow rate to the discharge passageway.

21 Claims, 7 Drawing Sheets

Fig. 3
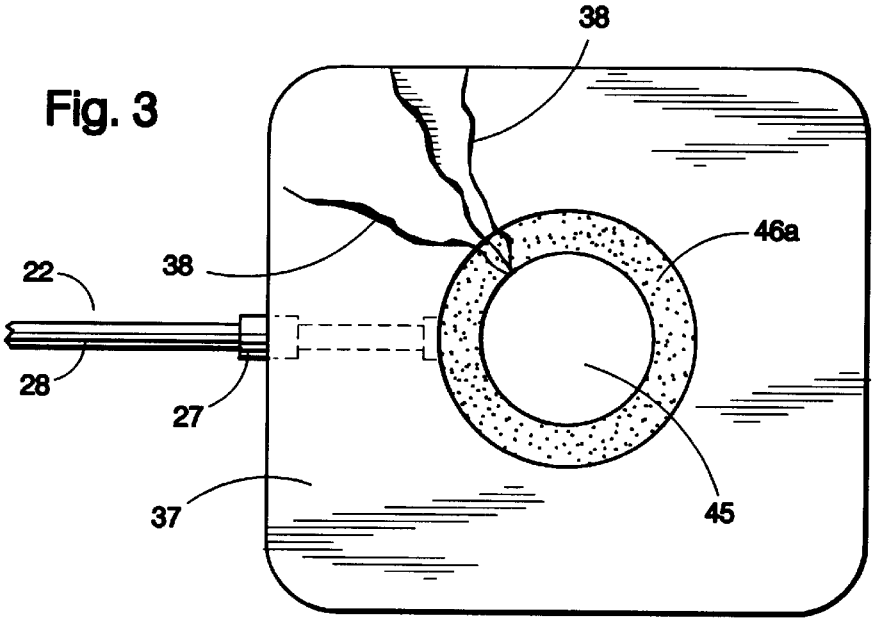
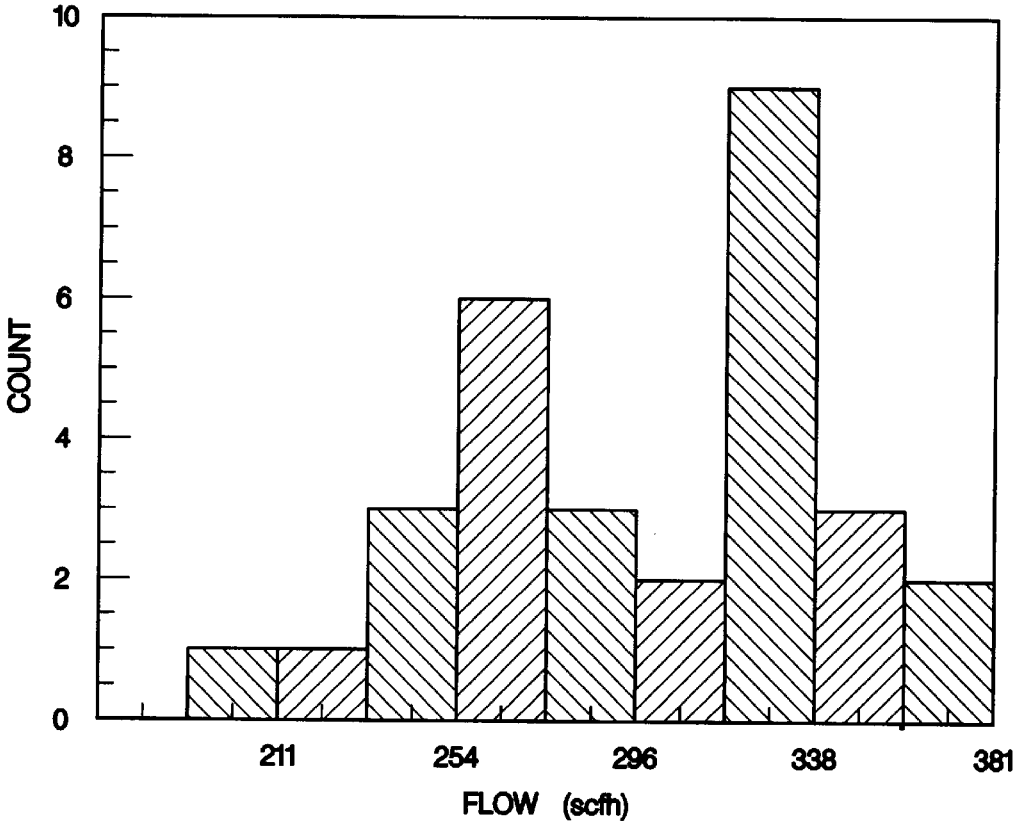
Fig. 4

21
INERT GAS SUPPLY
61
60
62
20
25
22
26
25
25
41
42
26a
26a
45a
40
45
26
27
45b
46
45c
26
47
28
49
45d
26a
43
48
45e
66
ATMOSPHERE
67
LEAKS
STEEL
68
65
70
CASTER CONTROL

APPARATUS AND METHOD FOR DELIVERING AN INERT GAS TO PREVENT PLUGGING IN A SLIDE GATE

FIELD OF THE INVENTION

This invention is directed to apparatus and a method for delivering inert gas to the discharge passageway in a slide gate used to drain liquid metal from a metallurgical vessel, and in particular, this invention is directed to a dynamic control system that delivers argon gas at a target gas flow rate to prevent, for example but not limited to, alumina plugging in a slide gate discharge passageway that drains liquid steel from a tundish into a continuous caster.

BACKGROUND OF THE INVENTION

In steelmaking operations, a slide gate is used to control the flow of liquid steel through a nozzle arrangement that drains the molten liquid steel from a metallurgical vessel. It is well known in the art that when inert gas is injected into the discharge passageway of the slide gate, the injected inert gas will reduce plugging or build-up that clogs the passageway. Continuing advancements in the art have led to the use of porous, gas permeable nozzles and slide gate plates that are able to deliver a continuous or intermittent inert gas flow to the discharge passageway where the delivered gas provides a gas barrier between the passageway surface and the liquid metal being drained. Such porous nozzles and slide gate plates are disclosed in U.S. Pat. No. 5,431,374 incorporated herein in its entirety by reference.

Referring to columns 1 and 2, the 374 patent discloses, although it is not certain, it is believed the inert gas flows through the porous nozzle walls, and advantageously forms a fluid film over the surface of the bore within the nozzle that prevents the liquid metal from making direct contact with the inner surface forming the bore. By insulating the bore surface from the liquid metal, the fluid film of gas prevents the small amounts of alumina that are present in such steel from sticking to and accumulating on the surface of the nozzle bore. The 374 reference also teaches that such alumina plugging will occur within the bore of a slide gate if an inert gas barrier is not provided. Therefore, as clearly taught in the art, for example, U.S. Pat. Nos. 4,756,452, 5,137,189, 5,284,278, and 5,431,374, inert gas barriers are used throughout the steelmaking industry to prevent alumina plugging within the discharge passageway that drains liquid steel from a tundish into the caster mold portion of a continuous caster.

Additionally, the 374 patent also discloses that in order to provide a proper inert gas barrier, the pressure of the inert gas must be maintained at a level sufficient to overcome the considerable back-pressure that the draining liquid steel product applies against the surface of the bore, and ideally, the gas pressure should be just enough to form the desired film or barrier. It is well accepted that injecting inert gas into a slide gate discharge passageway does reduce the plugging phenomenon, but metering the actual gas flow to the discharge-opening has long been a problem. Leaks in the gas delivery system are a repeating and continuous problem, and the measured amount of incoming gas flow is often different from the actual gas flow delivered to the liquid metal draining through the slide gate. Such gas delivery system leaks can occur in any one of the numerous pipefitting connections along the gas feed line extending between the inert gas supply and the slide gate mechanism. Additionally some leaks are dynamic in that they develop in the slide gate plates during casting operations as taught in U.S. Pat. No. 4,555,094. Historical information at our continuous casting operations shows that in many instances, no inert gas is delivered to the slide gate discharge passageway when the control gage readings show that the inert gas flow through the gas feed line is normal. The currently employed constant pressure or constant flow based control methods that are used to deliver inert gas to a slide gate mechanism cannot compensate for dynamic leaks, flow resistance changes, or unknown pressure drops, and therefore, they are ineffective for maintaining a target threshold gas flow within the discharge passageway. Consequently, the state-of-the-art inert gas delivery systems often fail to shield the bore surface from the liquid metal as taught in U.S. Pat. No. 5,431,374.

SUMMARY OF THE INVENTION

It is therefore an object of the present invention to provide an inert gas delivery system capable of providing a target threshold inert gas flow that prevents plugging within the discharge nozzle arrangement through which liquid metal is drained.

It is a further object of the present invention to provide an inert gas delivery system capable of measuring the amount of inert gas delivered to the discharge opening passageway where the system is capable of measuring the amount of inert gas lost through leaks so that the inert gas flow is maintained at a target threshold pressure within the discharge opening passageway.

It is another object of the present invention to provide an inert gas delivery system capable of measuring inert gas flow resistance to determine an amount of plugging that occurs within the discharge opening passageway that drains liquid metal from a metallurgical vessel.

It is an additional object of the present invention to provide a mathematical model that provides on-line evaluation and dynamic control of the inert gas delivery system so that a consistent inert gas flow is maintained to prevent or reduce plugging within the discharge opening passageway that drains liquid metal from a metallurgical vessel.

In satisfaction of the foregoing objects and advantages, the present invention provides a dynamic control system capable of delivering an inert gas at a target threshold gas flow rate to the discharge passageway in a slide gate draining a liquid metal product. The dynamic control system maintains the inert gas at a constant target threshold flow rate sufficient to prevent or reduce plugging within the discharge opening, and the dynamic control system includes a gas feed line extending between an inert gas supply and the slide gate discharge passageway, a gas flow regulator, a pressure gauge; and a gas feed flow control system that detects an amount of incoming inert gas flow lost through leaks in the system and adjusts the gas flow regulator in response to the detected amount of incoming gas flow loss so that the adjusted incoming gas flow continues to deliver the target inert gas flow rate to the discharge passageway.

BRIEF DESCRIPTION OF THE DRAWINGS

The above and other objects, advantages and novel features of the present invention will become apparent from the following detailed description of the preferred embodiment of the invention illustrated in the accompanying drawings, wherein:

FIG. 3 is a plan view of a slide gate top plate.

FIG. 4 is a histogram showing the flow variability for slide gate top plates at 20 psi.

DETAILED DESCRIPTION OF THE PREFERRED EMBODIMENT

The following detailed description of the present invention is directed to an inert gas delivery system that provides a gas feed at a target threshold flow to the discharge-opening extending through a slide gate in a continuous casting steelmaking operation. However, it should be understood that the scope of the present invention is not limited to steelmaking operations, and that the scope of the invention is intended to include any operation where it is necessary to provide a gas feed at a target threshold flow.

Figure 1:
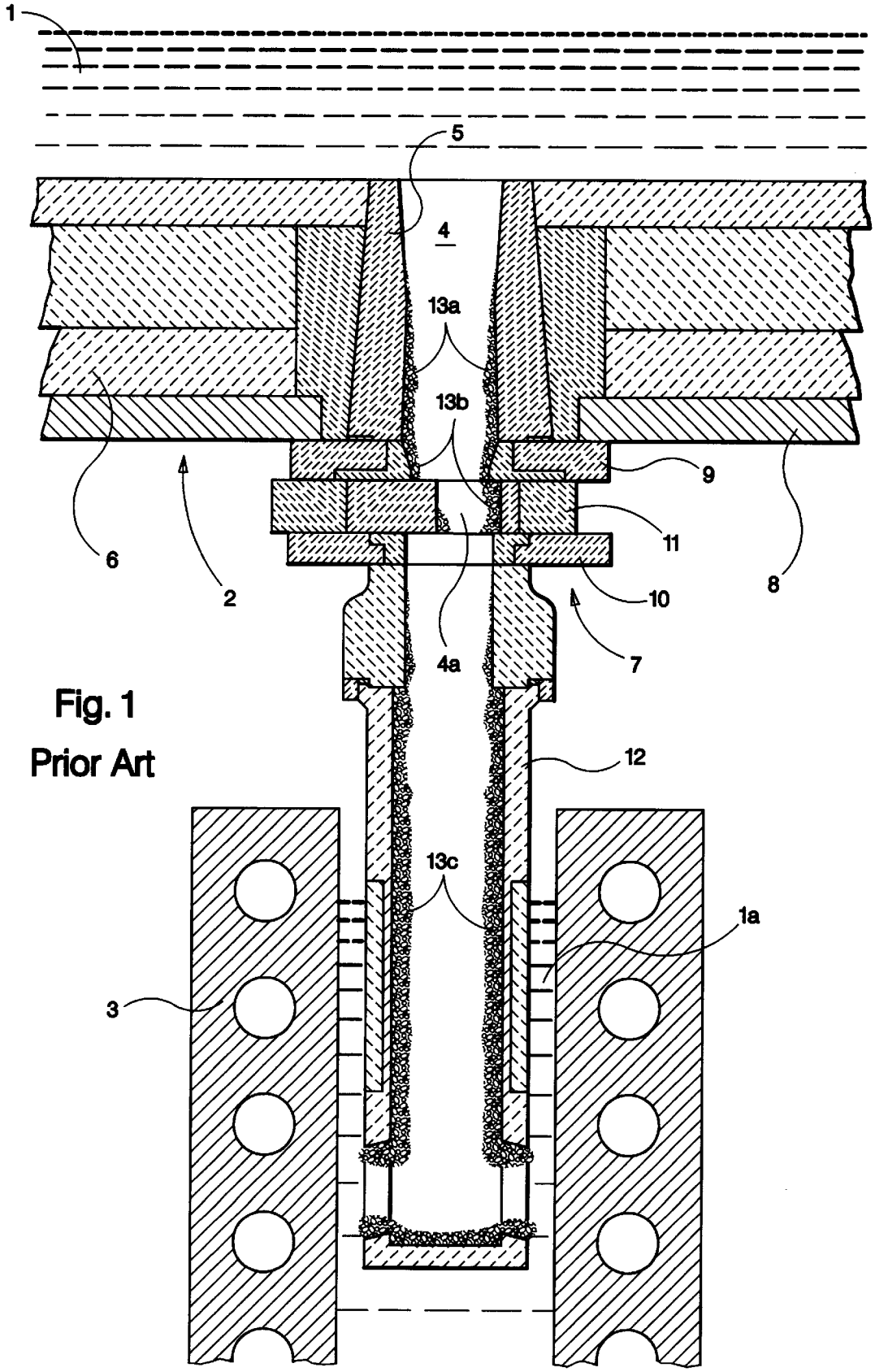
Fig. 1 Prior Art
FIG. 1 is a cross-section view of prior art showing typical plugging within a discharge-opening passageway that drains liquid steel from a continuous caster tundish.

Referring to FIG. 1 labeled prior art, in a continuous casting operation, a supply of liquid steel 1 is held in a reservoir called a tundish 2 to provide a continuous supply of liquid steel to the water-cooled caster mold 3 that begins the transformation of the liquid steel into a solidified steel product. The liquid steel 1 is drained from the tundish 2 through a discharge-opening passageway 4 that extends through a refractory nozzle 5 imbedded within the tundish floor 6, and a slide gate 7 attached to the tundish bottom plate 8 to regulate the amount of liquid steel 1 flowing through the discharge-opening passageway 4.

A slide gate 7 typically comprises a top plate 9, a bottom plate 10, sometimes called a tube holder plate, and a moveable throttle plate 11 located between the top and bottom plates 9 and 10, respectively. A passageway portion 4*a* extends through the throttle plate, and a hydraulic mechanism (not shown) is attached to throttle plate 11 so that it may be adjusted to position passageway portion 4*a* with respect to the discharge-opening passageway portion 4 through which the liquid steel is drained. The position of passageway portion 4*a* regulates the flow of liquid steel drained from tundish 2 and into the caster mold 3. The underside of the bottom plate 10 is adapted to receive a refractory tube 12 that is immersed within the cast steel 1*a* contained in mold 3. Such refractory tubes are used for casting steels to prevent the liquid steel product from being exposed to the atmosphere. It should be understood that various tube or shroud arrangements are used in continuous casting operations, and the present invention is not limited to use with a particular shroud arrangement.

One method for increasing profitability in such continuous casting operations is to maximize the number of heats processed through each tundish before it needs to be taken out of service for maintenance. When the total number of processed heats is increased, the probability of plugging also increases. Such plugging typically takes place along the tundish top plate and within the slide gate mechanism. This is particularly true in instances where titanium alloy and aluminum killed steel grades are being cast. Accumulation of alumina eventually leads to plugging of the passageway and prevents a free flow of liquid steel through the discharge-opening passageway 4. Such plugging causes erratic mold level control, steel product down grades, and unscheduled retirement of the tundish. As illustrated in FIG. 1, when for example, alumina in the steel contacts the surfaces of the discharge-opening passageway 4, they stick to the surfaces and cause plugging within the nozzle portion 13*a,* within the slide gate portion 13*b,* and within the tube shroud portion 13*c*. In the instance where the plugging 13*c* is within the tube shroud 12, robotic tube changers enable operators to make rapid tube changes with very little or no lost time in a continuous casting operation. However, with respect to plugging along portions 13*a* and 13*b,* such plugging along the nozzle and slide gate discharge-openings necessitates taking the tundish off-line to replace the nozzle and/or the clogged portions of slide gate mechanism. Such maintenance is both time consuming and expensive because it reduces the number of heats that can be processed during the service life of a tundish.

As taught in U.S. Pat. No. 5,431,374, when an inert gas such as argon, is injected into a discharge-opening passageway that drains liquid steel from a tundish, the inert gas forms a fluid film along the passageway surface that prevents the flowing liquid steel from contacting the passageway surface. However, the inventors have recognized that leaks in such inert gas delivery systems jeopardize the delicate pressure balance between back-pressure from the liquid steel and the inert gas feed pressure. In order to overcome leakage problems, the inventors disclose an "improved kind of nozzle mechanism that prevents or at least minimizes the accumulation of alumina deposits on the nozzle bore, and prevents gas leaks . . . ."

Figure 2:
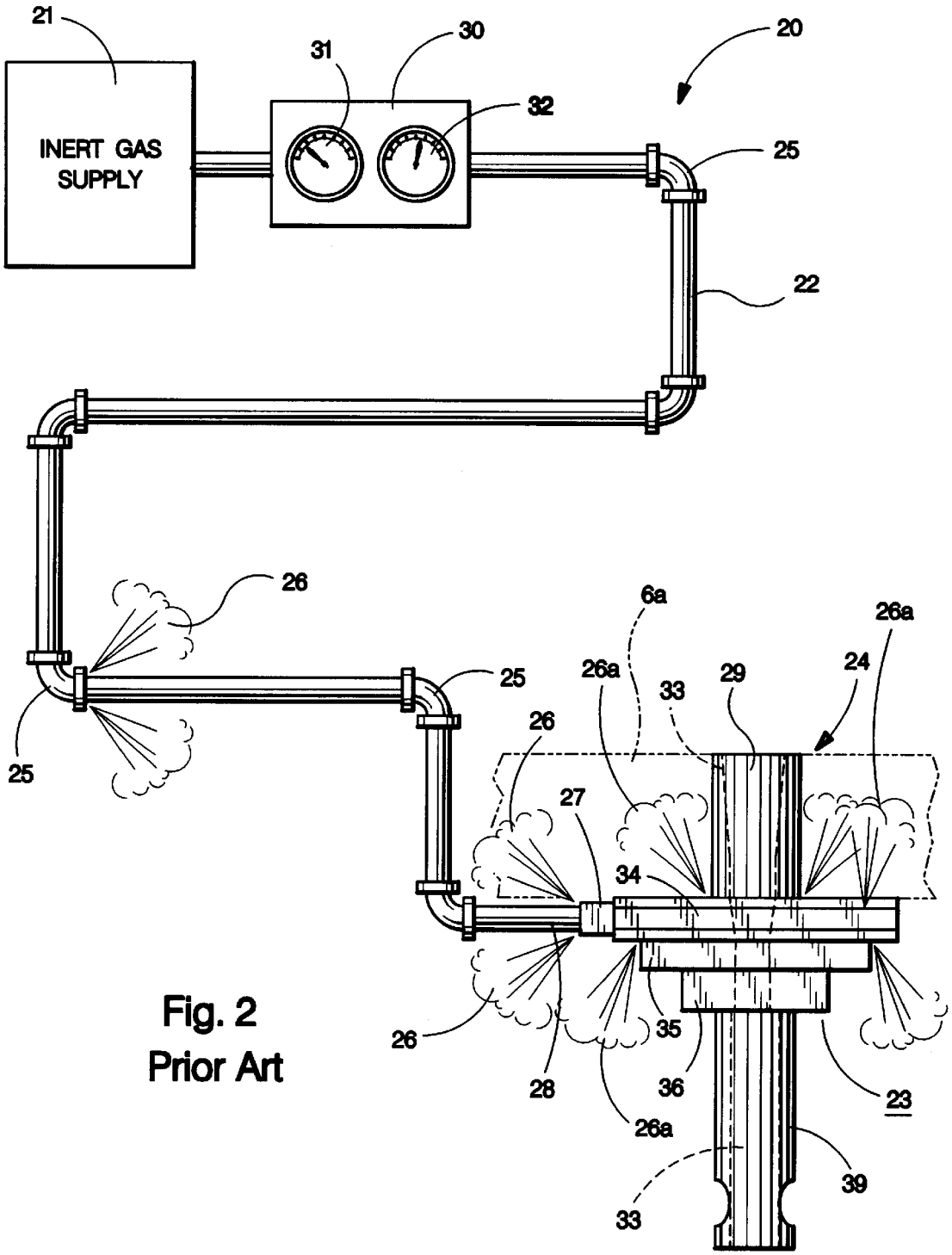
Fig. 2 Prior Art
FIG. 2 is a schematic view of a prior art inert gas delivery system.

Under real world continuous casting conditions, it is very difficult, and most times impossible, to eliminate all the gas leaks associated with an inert gas delivery system that provides a gas feed to the drain mechanism in a caster tundish. Referring to FIG. 2, a schematic drawing showing a gas delivery system 20 of the past, such past gas delivery systems comprise an inert gas supply 21 and a feed line 22 extending between the inert gas supply and a slide gate mechanism 23 assembly in a tundish drain 24. Such gas supply feed lines 22 typically follow a serpentine path from the gas supply 21 to the drain 24 so that they are able to conform to cast floor space requirements. Consequently, feed line 22 comprises various piping connections and turns 25 that are susceptible to leakage 26. Such piping leaks are usually responsive to continuous thermal shock (expansion and contraction) caused by the hostile caster environment, and leaks 26 may occur at any one of the connections 25 along the gas feed line 22 as well as at the connection end 28 that fastens feed line 22 slide gate mechanism 23.

Other gas leaks 26*a* may also occur when cracks develop in the refractory material used to make the slide gate plates. For example, referring to U.S. Pat. No. 4,555,094, and referring to the present FIG. 3 showing a plan view of a slide gate plate 37, cracks 38 may develop in any of the plates that make up a slide gate mechanism. Plate cracking can occur from thermal shock as well as mechanical pressures associated with continuous casting of liquid steel. Plate cracks 38 are problematic in an inert gas delivery system because it is difficult to define the drop in gas pressure caused by such leaks.

As illustrated in FIG. 2, a typical past tundish drain includes a refractory nozzle 29 imbedded within the tundish floor 6*a,* a shroud tube 39, and a slide gate mechanism 23 positioned between nozzle 29 and the shroud tube 39 to regulate the flow of liquid steel drained through the discharge-opening passageway 33. Most casters rely either on a flow based or on a pressure based control system for delivering a flow of inert gas to the tundish drain to prevent plugging. Such flow based or pressure based systems are not reliable as precise gas regulation systems under real-world conditions. For example, referring again to FIG. 2, when a flow based control system is used to deliver an inert gas flow to a tundish drain, it must be assumed that a flow meter 31, in an argon panel 30 positioned in the gas line 22, indicates the actual gas flow that will reach the discharge-opening passageway 33. This condition is defined in Equation (1).

$$Q=Q_1 \tag{1}$$

Where:

Q=flow meter reading (scfh) 31; and $Q_1$=flow into the discharge-opening passageway 33.

However, in actual operation, such gas delivery systems are not leak free, and a portion of the gas flow is always lost to atmosphere through gas leaks such as 26 and 26*a* as exemplified in Equation (2).

$$Q=Q_1+Q_2 \tag{2}$$

Where:

Q=flow meter reading (scfh) 31;

$Q_1$=flow into the discharge-opening passageway 33; and $Q_2$=gas flow to atmosphere 26 and/or 26*a*.

In such flow based gas delivery systems, flow meter 31 in argon panel 30 is only able to measure and control the gas output from the argon or inert gas panel 30. Such gas delivery systems of the past are not capable of controlling the amount of gas that is actually delivered to the discharge-opening passageway 33 to counteract plugging. Where a flow based control system is used to deliver an inert gas, it has been found that there are instances when no gas reaches the discharge-opening passageway. Such instances occur when leaks 26 and 26*a* are so large that they offer less resistance to gas flow than the resistance caused by the porous zirconia insert 46*a* in the slide gate plate shown in FIG. 3, and/or the back pressure resistance caused by the liquid steel draining from the tundish.

To summarize, past inert gas flow meters 31 are only capable of measuring and controlling the outflow of gas from the control panel 30. They are not able to measure and/or control the amount of gas that is actually delivered to the discharge-opening passageway 33 to counteract plugging.

Pressure-based inert gas delivery systems suffer similar problems. In a pressure based system, operators calculate pressure set points that are slightly above estimated pressure drops that occur within such gas delivery systems. In other words, the pressure set points are high enough to deliver a proper gas flow to the liquid steel stream draining through the discharge-opening passageway 33 of the tundish drain arrangement. An exemplary equation for calculating such pressure set points is shown in the following Equation (3).

$$P_b=P_1+P_2+P_3 \tag{3}$$

Where:

$P_b$=back pressure (psi) read in pressure gauge 32 at the argon panel 30;

$P_1$=pressure drop (psi) in the delivery pipe 22;

$P_2$=liquid steel static pressure (psi) at the slide gate plate receiving the delivered gas flow; and $P_3$=over pressure (psi) need to produce the desired flow to the discharge-opening passageway 33.

Because static pressure will vary with respect to the liquid metal throughput and with respect to the ferrostatic head of the liquid metal, static pressure must be calculated for each new casting condition. In current steelmaking practice, Bernoulli's equation is often used to calculate static pressure in a gravity fed metal drain or teeming system as shown in Equation (4).

$$P_S=(W\times(H-(V^2/(2\times G)))\times Coefficient \tag{4}$$

Where:

$P_S$=static pressure (psi);

W=liquid metal specific weight (lbs/in$^3$);

H=ferrostatic head (in);

V=liquid metal velocity (in/min); and

G=gravitational constant (in/min$^2$).

Such static pressure calculations are rudimentary at best, and application of Bernoulli's equation is often complicated by real-world coefficients that must be determined experimentally and applied to the resultant. For example, water model tests show that the coefficients decrease with bore size, the coefficient for a 3.5 inch diameter bore being about 0.598. Even if static pressure could be accurately predicted, it would still be very difficult to determine the exact over-pressure needed to solve Equation (3). This is because the resistance from the slide gate plate inserts 46*a* will vary with each insert, and therefore, it is difficult to predict proper pressure to overcome insert resistance and to achieve a desired gas flow at the slide gate plate receiving the delivered gas flow.

In an attempt to overcome such past problems associated with delivering a target gas flow to a discharge-opening passageway, a random sampling of 30 slide gate top plates 34 were selected from inventory, and the plates were tested to determine pressure/flow response at the porous inserts 46*a*. The resulting histogram, FIG. 4, illustrates gas output flow based upon a constant 20 psi (1.4062 kgs/cm$^2$) gas input to each plate tested. The test results show that at a constant input pressure, output gas flow will vary from plate to plate by about 190 to 381 scfh (90 to 180 slm). This is a 100% difference in output rates depending upon the particular plate tested. It should also be noted that distribution of the flow is not normal, it is bimodal. With such a variation in the top plate population, it is inappropriate to use an average over pressure value to solve Equation (3). It would appear that one approach for solving Equation (3) would be to measure and record the pressure and flow characteristic of each top plate before it is installed in the slide gate mechanism. However, such added steps during tundish construction or maintenance is expensive, and as shown below, such measurement efforts fail to accurately represent pressure/flow relationship during actual casting or teeming operations.

In order to maintain a target threshold pressure in an inert gas delivery system, pressure drops along the feed line and at the slide gate plate receiving the delivered gas, as well as the temperature dependence of the inert gas flow, must be considered. Such changing conditions are illustrated in the pressure/flow diagram shown in FIG. 5. The pressure/flow diagram represents the flow response for three different study conditions in a gas delivery system. Study 1 illustrates flow response in a gas delivery system where the gas feed line is not connected to a slide gate plate. In Study 2, the gas feed line is connected to a slide gate plate during the vessel preheating operation. And finally, Study 3 shows gas flow response during casting or teeming operations where the gas feed line is connected to a slide gate plate. The slope of each case Study 1–3 represents flow resistance of the gas delivery system, and this flow resistance value can be calculated using the following Equation (5).

$$R=\Delta P/\Delta Q \quad (5)$$

Where:

R=total flow resistance (psi/scfh);

ΔP=delta back pressure (psi) at the argon panel; and

ΔQ=delta flow (scfh) at the argon panel.

Figure 5:
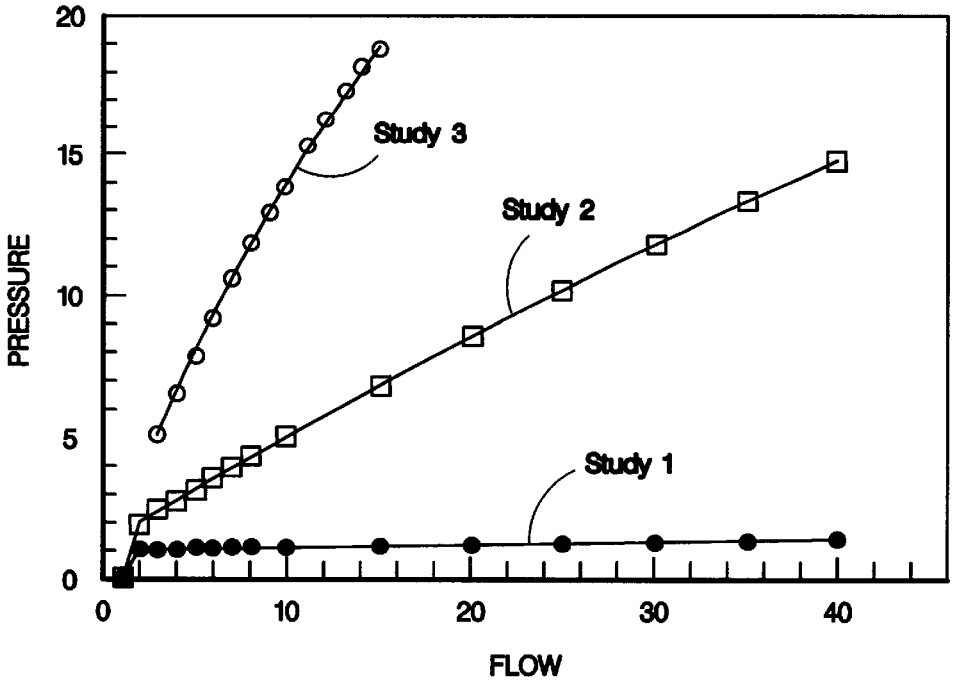
FIG. 5 is a graph showing changes in gas flow resistance under different conditions in an inert gas delivery system.

As clearly shown in FIG. 5, when a gas delivery system is tested before it is connected to the top plate in a slide gate mechanism, as shown in Study 1, there is a slight increase in back pressure when the gas flow rate reaches about 2 scfh (56.6 slm). This increase in back pressure is caused by frictional resistance along the gas feed line and/or by low-end error in the measuring system. Such back pressure resistance is normally low if the pipe is properly sized to the specifications of the delivery system. However, if the pipe is undersize, substantial back pressure may occur, and such resistance to gas flow must be considered in the total evaluation of the gas delivery system in order to properly maintain target threshold pressure. After the gas feed line is attached to the top plate, and after the metallurgical vessel is placed into a preheat condition as shown in Study 2, back pressure resistance increases significantly. The additional flow resistance is caused by the combination of resistance from the porous insert and resistance from gas expansion along the gas feed line subjected to the preheat conditions. Gas expansion will also occur at the preheated porous insert where the gas temperature is elevated to over 1000° F. (538° C.). Such gas expansion is very rapid, and it creates a back pressure that increases gas flow resistance significantly in the gas delivery system as illustrated in FIG. 5. The gas flow resistance is further increased as the vessel temperature is further elevated during casting operations as exemplified in Study 3, and flow resistance is also increased when the inert gas is brought into contact with the liquid metal product being drained through the discharge-opening passageway during casting or teeming operations. Such changes in gas flow resistance are not predictable because back pressure is dependent upon the combination of steelmaking temperatures and plugging at the top plate and within the discharge-opening passageway. Therefore, because flow resistance changes are unpredictable, the above suggested solution where pressure and flow is measured and recorded for each top plate before it is installed in a slide gate mechanism, fails to accurately represent the pressure/flow relationship during actual operations.

Figure 6:
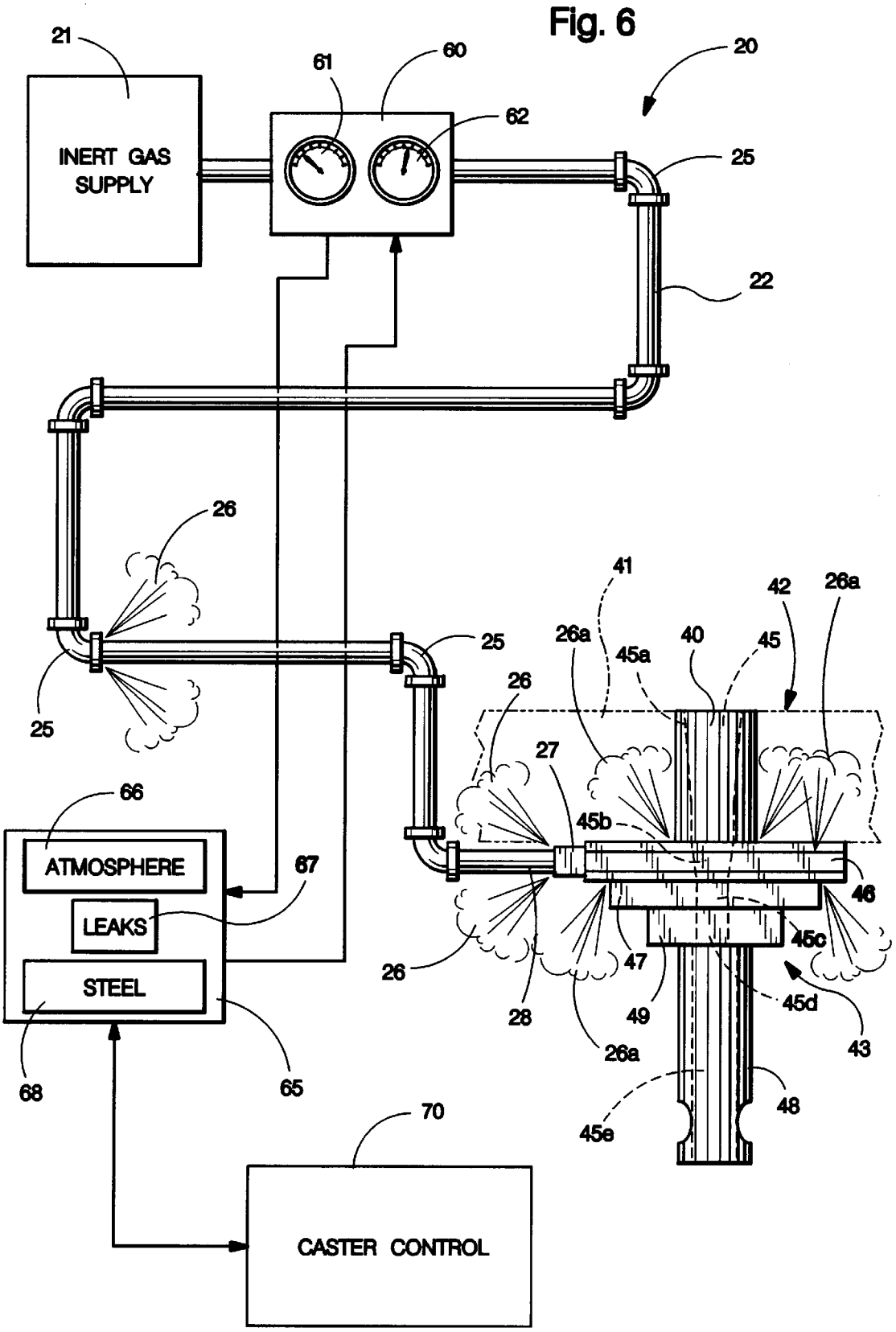
FIG. 6 is a schematic view of the inert gas delivery system for the present invention.
Figure 6A:
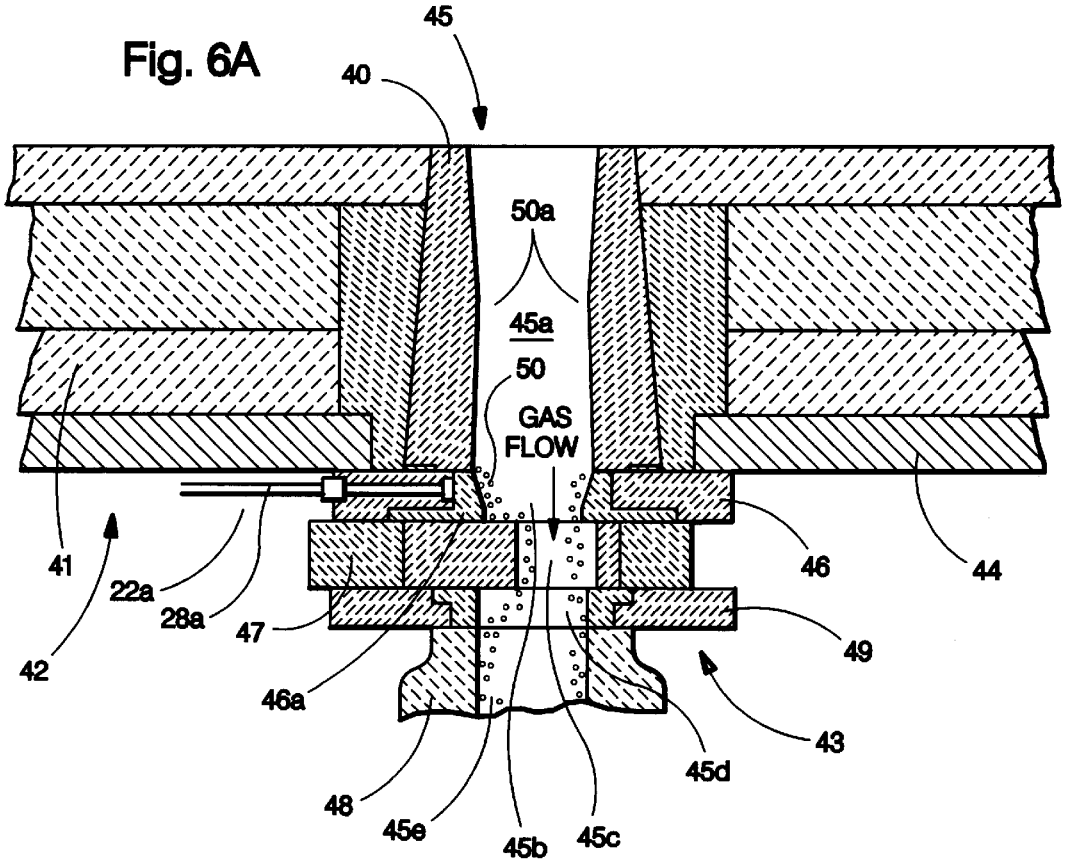
FIG. 6A is a cross-section view showing inert gas delivered to a slide gate top plate.
Figure 6B:
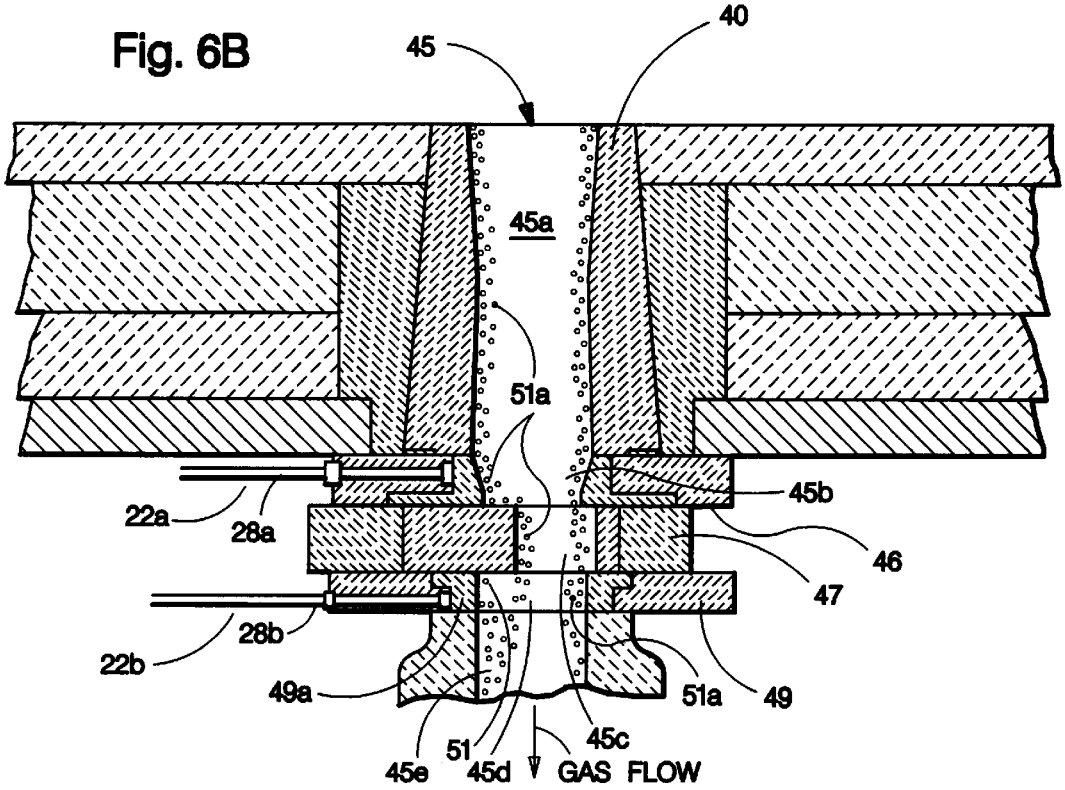
FIG. 6B is a cross-section view showing inert gas delivered to a slide gate top plate and a slide gate bottom plate.

Referring to the preferred embodiment of the present invention shown in drawing FIGS. 6 and 6*a,* a refractory nozzle 40 is imbedded within the floor 41 of a tundish 42. A slide gate mechanism 43 that includes a top plate 46, a throttle plate 47, and a tube holder plate 49. Slide gate mechanism 43 is attached to the tundish bottom 44 so that the discharge-opening portion 45*b,* extending through the slide gate top plate 46 is aligned with the discharge-opening portion 45*a* extending through nozzle 40. The position of the slide gate throttle plate 47 is adjustable using a hydraulic mechanism or the like (not shown), to regulate the flow of liquid metal draining through the discharge-opening passageway 45 as heretofore described above. A tube shroud 48 is attached to the tube holder plate 49 to provide a final discharge-opening portion 45*e* that extends downward from the discharge-opening portion 45*d* in tube holder plate 49 and into the caster mold (not shown) where it is immersed in the cast liquid steel. An inert gas feed line 22*a* extends from the gas supply 21, shown in FIG. 6, and its output end 28*a* is connected to the porous gas permeable refractory material 46*a* that defines opening 45*b* as shown in FIGS. 3 and 6A. The inert gas is injected through the porous material 46*a* and into the discharge-opening portion 45*b* at a target threshold pressure that is greater than the back pressure of the liquid metal flow through the discharge-opening passageway 45, and a portion of the injected inert gas washes the top surface of throttle plate 47 to provide a gas barrier 50 that prevents alumina or other alloys from plugging within or adjacent the discharge-opening portion 45*c* extending through the throttle plate. The injected inert gas also provides a shield 50*a* that prevents plugging along the discharge-opening portions 45*a* and 45*b*. Although drawing FIG. 6A shows the inert gas feed line 22*a* delivering a gas flow to the top plate 46 in the slide gate mechanism 43, it should be understood that gas feed line output end 28*a* may just as well be attached to any of the slide gate plates in the mechanism, for example throttle plate 47 or the tube holder plate 49, just as long as the steel inside the discharge-opening passageway 45 is at a positive pressure (above atmosphere). To illustrate such an alternate embodiment, FIG. 6B shows a gas delivery system comprising a second gas feed line 22*b* that may be attached to either the throttle plate 47, or the tube holder plate 49. However, it should be understood that an inert gas feed should only be delivered to slide gate plates 47 and 49 if the liquid metal flow through their respective discharge-opening portions 45*c* and 45*d* does not create a negative pressure or vacuum that prevents injecting inert gas at a positive pressure (above atmosphere). In FIG. 6B, the second inert gas feed line 22*b* is shown attached to a porous gas permeable refractory insert 49*a* that defines the discharge-opening portion 45*d* in the tube holder plate 49. The inert gas is injected through the porous material insert 49*a* at a target threshold pressure that is greater than the back pressure created by the liquid metal flow through the discharge-opening passageway 45, and a portion of the injected inert gas washes the bottom surface of throttle plate 47 to provide a gas barrier 51 that prevents, for example, alumina sticking thereto. The injected inert gas provides a barrier or film 50 and/or 51 extending along the discharge-opening portions 45*b,* 45*c,* and 45*d* of the top plate 46, throttle plate 47, and tube holder plate 49 respectively to prevent plugging along the discharge-opening portions. It should be understood that although FIG. 6B shows dual gas feed lines 22*a* and 22*b,* a single line gas feed line, for example 22*a,* may be used to deliver inert gas to either the throttle plate 47 or to the bottom tube holder plate 49 without departing from the scope of this invention. Additionally an optional gas feed line (not shown) may be adapted to inject inert gas into the nozzle opening 45*a* to provide a barrier or film that prevents alumina buildup therein without departing from the scope of this invention.

Precise regulation of the inert gas delivery system is critical if the gas barriers 50—50*a* and/or 51—51*a* are to be maintained at a level where they effectively prevent alumina or alloy plugging along the discharge-opening passageway 45. Surprisingly, prior teaching is silent with respect to maintaining such precise regulation of the gas supply. Therefore, considering such lack of teaching, current state-of-the-art slide gate technology fails to provide a constant target threshold pressure in the inert gas flow delivered to the discharge passageway through which the liquid steel is drained.

In an attempt to overcome this problem, a control system was developed to both calculate the magnitude of leaks in a gas delivery system, and to provide gas flow adjustments needed to maintain a consistent target threshold flow. For example, referring again to FIGS. 6 and 6A, the gauge on valve 61 measures the inert gas input flow from supply 21, and the pressure gauge 62 measures back pressure in the gas delivery system. However, such gas flow and pressure gauges 61 and 62 provide insufficient data for operators to determine what exactly happens to the inert gas flow downstream of panel 60 because of unpredictable flow resistance changes in the gas delivery system. Three possible inert gas flow scenarios can occur in a gas flow downstream of panel 60. First, the entire gas flow could be discharged to atmosphere through leaks 26 and 26*a* shown in FIG. 6. Second, the entire gas flow could be delivered to the discharge-opening passageway 45 to provide a barrier between the discharge-opening and the steel being drained through passageway 45. And finally, in a most likely case scenario, the input gas flow would be both leaked to atmosphere and delivered to the passageway 45 as a gas flow ratio (gas leaked/gas delivered).

Figure 7:
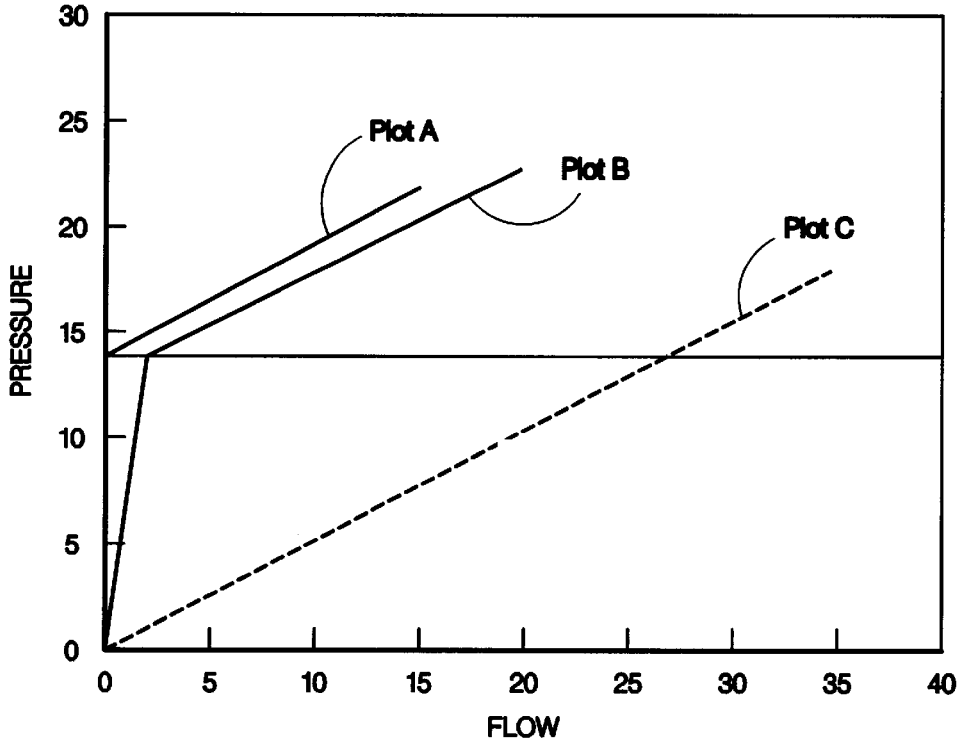
FIG. 7 is a graph showing the pressure/flow relationship for three different gas flow scenarios in an inert gas delivery system.

In scenario-1, where the entire gas flow exits the delivery system through leaks 26 and 26*a,* the pressure vs. flow relationship is similar to Plot C in FIG. 7. In such an instance, Equation (6) may be used to describe the pressure/flow relationship.

$$P=(R\times Q)+\text{constant} \tag{6}$$

Where:

The constant is zero because the entire gas flow is delivered to atmosphere through system leaks;

P=actual back pressure 62 (psi) at the argon panel 60;

R=total flow resistance (psi/scfh) at argon panel 60; and

Q=measured gas flow 61 (scfh) at the argon panel 60.

The slope of Plot C indicates flow resistance, and the flow resistance may be calculated using the following exemplary Equation (7).

$$R=\Delta P/\Delta Q \tag{7}$$

Where:

R=total flow resistance (psi/scfh) at argon panel 60;

ΔP=change in actual back pressure (psi) at the argon panel

ΔQ=change in flow (scfh) at the argon panel.

On the other hand, when the entire gas flow is delivered to the steel draining through the discharge-opening passageway 45, the gas flow must be injected into a pressurized system (above atmosphere). At a zero flow, the measured pressure is equal to or less than the static pressure at the slide gate plate receiving the gas flow. The static pressure in the slide gate plate must be overcome before the gas flow can be delivered to the discharge-opening passageway 45. As indicated above, static pressure ($P_S$) is calculated using exemplary Equation (4), and the calculated $P_s$ value is used as the constant in Equation (6) to determine actual, real-time system back pressure.

The problem of delivering the gas flow to the discharge-opening at a target threshold pressure may be simplified by assuming that all the leaks 26 and 26*a* may be lumped as a sum parameter, and that the pressure and flow relationship in the gas delivery system is linear. Referring to the pressure and flow diagram shown in FIG. 7, if the system back pressure exceeds the steel static pressure, inert gas is lost to leaks that occur throughout the system and some remaining inert gas is delivered to the liquid metal being drained through the discharge opening passageway 45. Such an inert gas flow is illustrated as Plot B in FIG. 7. Plot B is a "best" real-world representation of actual casting conditions. On the other hand, if the system back pressure is below the steel static pressure, the total inert gas flow will exit panel 60 and escape to atmosphere through the system leaks 26 and 26*a* as shown by Plot C. Plot A is representative of a perfect gas delivery system with no gas leaks to atmosphere. Such leak free systems seldom, if ever, occur within a hostile casting environment. It can be seen by the graphical representation in FIG. 7 that a common point is shared by all conditions, the common point being the ferrostatic pressure $P_s$ of the liquid metal contained in the vessel being drained.

Based upon the information contained in FIG. 7, the following exemplary Equation (8) was derived to determine gas flow loss to system leaks.

$$Q_L=\frac{P_b(P_s-(P_b-(R\times Q)))}{(P_s\times R)} \tag{8}$$

Where:

$Q_L$=gas flow (scfh) loss to leaks;

$P_b$=back pressure 62 (psi) at the argon panel 60;

$P_s$=static pressure (psi);

R=total flow resistance (psi/scfh) at argon panel 60, and

Q=measured gas flow 61 (scfh) at the argon panel 60.

Gas delivery system leaks may be calculated with Equation (8) if 4-variables are known. The variables include 1) total flow resistance at argon panel 60; 2) back pressure 62 at argon panel 60; 3) static pressure calculated from known casting conditions such as vessel volume and the liquid metal ferrostatic head; and 4) flow resistance determined by inputting a small increase in gas input flow at valve 61 and measuring the back pressure 62 response. Total gas flow to the draining liquid metal is determined by subtracting the total leaks from the total flow as using Equation (9).

$$Q_s=Q-Q_L \tag{9}$$

Where:

$Q_s$=gas flow to the liquid metal;

$Q_L$=gas flow loss to leaks; and

Q=measured gas flow 61 at the argon panel 60.

It is important to calculate the static pressure $P_s$ accurately in Equation 4 because the $P_s$ represents actual static pressure at the slide gate plate receiving the delivered gas flow. As shown in Equation 4, since the equation is theoretical, some coefficient may be needed. Such coefficients are dependent upon passage 45 geometry and must be determined for each configuration. For the slide gate top plate system at our operation, no coefficient was required.

EXAMPLE

Figure 8:
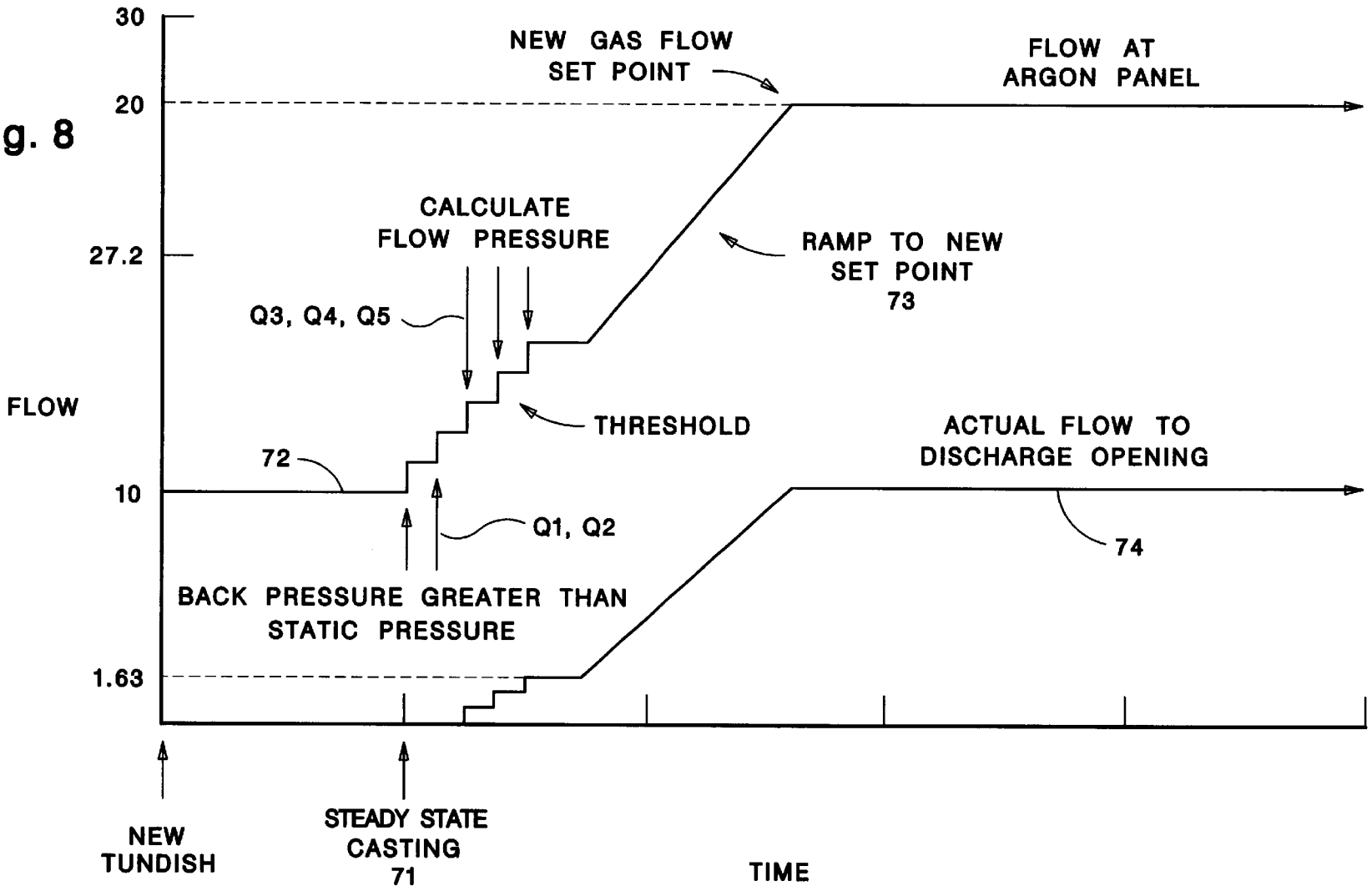
FIG. 8 process control chart showing the steps of the present invention to deliver an inert gas flow to the top plate in a slide gate.

Referring to FIG. 8 and to the apparatus shown in FIG. 6, FIG. 8 illustrates one possible procedure for carrying out the steps of the present invention to deliver an inert gas at a target gas flow rate to the top plate 46 (FIG. 6) in a slide gate mechanism 43 that drains molten steel from a tundish 42. In the present example, a 60-ton tundish 42 is positioned to drain liquid steel into a continuous caster that operates at a casting speed of 42 inches/minute. The caster mold (FIG. 1) is 60.70 inches wide and 10 inches thick, and the ferrostatic head inside the tundish 42 is measured at 68.05 inches. The slide gate mechanism 43 is attached to the tundish bottom to control the flow of liquid steel drained from the tundish, and the slide gate top plate 46 has a 3.5 inch diameter bore through which the liquid steel is drained.

At the beginning of a cast cycle, a flow set point is entered into a flow control means. In this instance, the set point is entered into computer 65. The control set point is a selected argon gas flow rate to the discharge opening passageway 45 that is sufficient to overcome static pressure inside the passageway and prevent plugging. In this example, the set point is 10 scfh (standard cubic feet/hour). The gas delivery system is activated and computer 65 communicates with the caster control 70 to receive various process variables associated with the above-defined caster and tundish specifications, for example, cast speed, mold width, tundish weight, etc., to determine if the variables are within predetermined limits; and to determine that a "steady-state casting" condition 71 is reached before computer 65 proceeds to define values needed to provide a dynamic control of the argon gas flow through the gas delivery system to the discharge passageway 45.

Once steady-state casting is reached, computer 65 calculates liquid steel static pressure inside top plate bore using, for example, equation (4). It should be noted, however, that the static pressure could be measured using a sensor device without departing from the scope of this invention. The ferrostatic head needed to solve equation (4) is determined by either manually measuring the bath level in the tundish or by automatically calculating bath level based upon tundish weight and the known tundish geometry. The velocity of the steel draining through passageway 45 is calculated using known total flow of steel derived from the cast speed, the mold cross-section area, and the bore diameter in the top plate 46. Computer 65 compares the calculated liquid steel static pressure with the back pressure measurement on gauge 62 to determine whether the back pressure is above or below or the calculated liquid steel static pressure inside the top plate bore. In the present example, the liquid steel static pressure is calculated at 16.32 psi, which is higher than the measured 15.57 psi back pressure at the 10 scfh delivery flow 72 (FIG. 8). In response to this difference where static pressure is greater than back pressure, computer 65 generates an output signal to the gas flow regulator 61 so that the gas flow is incrementally adjusted about 1 scfh higher than the original 10 scfh set point. Computer 65 compares the adjusted new back pressure with the liquid steel static pressure, and if the new back pressure is less than the calculated static pressure of 16.32 psi, the gas flow is incrementally adjusted higher from its original 10 scfh set point. The program continues to run a sequence of comparisons and adjustments until an adjusted new back pressure exceeds the calculated liquid steel static pressure. A typical set of such sequential comparisons and adjustments are shown below as Q1–Q5. The Q1–Q5 data is also plotted in FIG. 8.

Q1 10 scfh, 15.70 psi

Q2 11 scfh, 16.09 psi

Q3* 12 scfh, 16.61 psi

Q4* 13 scfh, 17.13 psi

Q5* 14 scfh, 17.65 psi

* back pressure ($P_b$) exceeds the liquid steel static pressure ($P_s$)

Referring to gas flow adjustment (Q3), the incremental 12 scfh gas flow adjustment produces a new 16.61 psi back pressure that is greater than the calculated liquid steel static pressure of 16.32 psi. The computer stores the (Q3) information, and the gas flow is incrementally adjusted upward to 13 scfh and 14 scfh at (Q4) and (Q5) respectively. The resulting new back pressures are entered into the memory for each setting (Q4) and (Q5), and the computer determines flow resistance R of the gas as it exits argon panel 60 by using the plurality of stored points (Q3), (Q4), and (Q5) in a linear regression equation to determine flow resistance in Equation 5.

In the present example, a total resistance (R) value of 0.5209 psi/scfh from equation (5) is used in exemplary equation (8) to solve for $Q_L$ (gas lost to leaks). Computer 65 receives continuing R value updates and solves $Q_L$ to generate a real-time display 66 that indicates an amount of gas being discharged to atmosphere through leaks 67. Additionally, by subtracting gas lost to leaks from the total argon gas flow through the argon panel 60, equation (9), computer 65 generates a real-time display 68 indicative of the gas flow rate being delivered to the top plate bore to counteract plugging. Entering the above exemplary information into equations (8) and (9) respectively, we find that in this example, 12.37 scfh of argon gas is discharged into the atmosphere through leaks 26 or 26*a,* and that only 1.63 scfh of argon gas is delivered to the top plate bore to prevent plugging.

Computer 65 compares current gas-lost/gas-delivered information with the stored original gas flow set point information and back-calculates to provide a total gas flow increase necessary to deliver the desired 10 scfh set point of argon gas to the top plate bore. In this example the amount of gas flowing from the argon panel must be increased or ramped-up to 27.2 scfh 73 (FIG. 8) to deliver a 10 scfh argon gas flow 74 to the steel draining through passageway 45 (FIG. 6).

The inert gas delivery system periodically reads real-time back pressure values at the argon panel for the purpose of indicating a possible change in the amount of inert gas lost as leaks. If a back pressure change is detected, the system will once again determine if the casting is at a steady-state condition before repeating the above-disclosed steps of the present invention to provide an increase or decrease in the total inert gas flow sufficient to deliver argon gas to the discharge passageway at the original 10 scfh set point. Such continuous monitoring of the gas delivery system may be accomplished by selecting a time interval between updates, or it may be accomplished by continuously monitoring for any changes in the back pressure that indicate a change in gas lost to leaks or increased plugging in the discharge passageway.

Although the above example discloses a computerized gas delivery system that automatically calculates and adjusts gas flow so that inert gas is delivered at a desired set point gas flow rate, it should be understood that any or all of the calculations, and that any or all of the gas flow adjustments may be done manually without departing from the scope of this invention. It should also be understood that while this invention has been described as having a preferred embodiment, it is capable of further modifications, uses, and/or adaptations of the invention, following the general principle of the invention and including such departures from the present disclosure as have come within known or customary practice in the art to which the invention pertains, and as may be applied to the central features hereinbefore set forth, and fall within the scope of the invention of the limits of the appended claims.

I claim:

1. Apparatus to deliver inert gas at an incrementally adjusted target flow rate to a discharge passageway in a slide gate that drains liquid steel from a tundish into a continuous caster, comprising:

a) a gas feed including an inert gas supply, a gas feed line extending between said inert gas supply and the discharge passageway to deliver an incoming gas flow to the discharge passageway, a gas flow regulator, and a pressure gauge; and b) a gas feed flow control that detects an amount of incoming gas flow lost through leaks in said apparatus, and incrementally adjusts said gas flow regulator in response to said detected amount of incoming gas flow lost through leaks so that said incoming gas flow is adjusted to deliver said target flow rate of inert gas to the discharge passageway.

2. The invention recited in claim 1 wherein said gas feed flow control includes a programmed means to periodically monitor said apparatus to detect any change in said amount of incoming gas flow lost through leaks, said gas feed flow control adapted to provide automatic incremental adjustment of said gas flow regulator in response to any detected change in the amount of incoming gas flow lost through leaks so that said incoming gas flow through said gas feed line is incrementally adjusted to maintained said target flow rate of inert gas to the discharge passageway.

3. The invention recited in claim 1 wherein said gas flow control means includes a programmed means to continuously monitor said apparatus to detect any change in said amount of incoming gas flow lost through leaks, said gas feed flow control adapted to provide automatic incremental adjustment of said gas flow regulator in response to any detected change in the amount of incoming gas flow lost through leaks so that said incoming gas flow through said gas feed line is incrementally adjusted to maintain said target flow rate of inert gas to the discharge passageway.

4. The invention recited in claim 1 wherein said gas flow control means is a programmable computer.

5. The invention recited in claim 1 wherein said inert gas is delivered at said incrementally adjusted target flow rate to a slide gate top plate bore.

6. The invention recited in claim 1 wherein said inert gas supply is argon.

7. A method for operating a gas delivery system that provides an incrementally adjusted target gas flow rate of inert gas to a discharge passageway in a slide gate that drains liquid steel from a tundish into a continuous caster, the steps of the method comprising:

determining an amount of inert gas lost through leaks in said gas delivery system, said amount of inert gas lost to leaks determined from a measured back pressure in said gas delivery system, a measured incoming gas flow rate in said gas delivery system, a gas flow resistance calculated from said measured back pressure and said measured incoming gas flow rate, and a static pressure of the liquid steel draining through the discharge passageway, and incrementally adjusting said incoming gas flow rate in response to said determined amount of inert gas lost to leaks so that said target gas flow rate of inert gas is delivered to the discharge passageway.

8. The method recited in claim 7 including the further step, comprising:

determining said amount of inert gas lost through leaks when said measured back pressure is greater than said static pressure of the liquid steel draining through the discharge passageway.

9. The method recited in claim 7 including the further step, comprising:

determining said amount of inert gas lost through leaks when the continuous caster is operating at a steady-state casting condition.

10. The method recited in claim 9 including the further step, comprising:

communicating with the continuous caster to automatically determine when the continuous caster is operating at a steady-state casting condition.

11. The method recited in claim 7 including the further steps, comprising:

monitoring said measured back pressure and said measured incoming gas flow;

providing continuing updates of said inert gas lost through leaks; and providing continuing incremental adjustments of said incoming gas flow in response to said continuing updates of said inert gas lost through leaks so that said target gas flow rate of inert gas is delivered to the discharge passageway.

12. The method recited in claim 7 wherein said target gas flow rate of inert gas prevents plugging in the discharge passageway.

13. The method recited in claim 7 wherein said target gas flow rate of inert gas is delivered to a slide gate top plate bore.

14. The method recited in claim 7 wherein said inert gas flow through said gas delivery system is argon.

15. A method for maintaining a target flow rate of inert gas to a discharge passageway in a slide gate that drains liquid steel from a tundish into a continuous caster, the steps of the method, comprising:

providing an incoming inert gas feed at a desired gas flow rate set point delivering said incoming inert gas feed to the discharge passageway;

operating the continuous caster at a steady-state casting condition;

determining static pressure of the liquid steel draining through the discharge passageway;

adjusting incrementally incoming inert gas feed to a higher gas flow rate;

determining when said adjusted incoming inert gas feed produces a back pressure in the inert gas feed that is greater than said static pressure of the liquid steel draining through the discharge passageway;

determining flow resistance in the incoming inert gas feed when said produced back pressure is greater than said static pressure of the liquid steel draining through the discharge passageway;

detecting an amount of incoming inert gas lost through leaks in said incoming inert gas feed, said amount of incoming inert gas lost to leaks determined from said produced back pressure, a measured incoming gas flow rate in said gas feed, said gas flow resistance, said static pressure of the liquid steel draining through the discharge passageway, and adjusting said measured incoming gas flow rate in response to said detected amount of incoming inert gas lost to leaks so that said target flow rate of inert gas is delivered to the discharge passageway.

16. The method recited in claim 15 wherein said amount of incoming inert gas lost through leaks ($Q_L$) is determined from the equation:

$$Q_L = \frac{P_b(P_s - (P_b - (R \times Q)))}{(P_s \times R)}.$$

17. The method recited in claim 15 including the further steps, comprising:

providing a programmed controller to maintain said target flow rate of inert gas to a discharge passageway;

determining with said programmed controller said back pressure ($P_b$), said static pressure ($P_s$), and said flow resistance (R);

detecting with said programmed controller said amount of incoming inert gas lost to leaks ($Q_L$); and adjusting with said programmed controller said measured incoming gas flow rate in response to said detected amount of incoming inert gas lost to leaks so that said target flow rate of inert gas is delivered to the discharge passageway.

18. The method recited in claim 17 wherein said amount of incoming inert gas lost to leaks ($Q_L$) is determined from the equation:

$$Q_L = \frac{P_b(P_s - (P_b - (R \times Q)))}{(P_s \times R)}.$$

19. The method recited in claim 15 wherein said target gas flow rate of inert gas prevents plugging in the discharge passageway.

20. The method recited in claim 15 wherein said target gas flow rate of inert gas is delivered to a slide gate top plate bore.

21. The method recited in claim 15 wherein said inert gas flow through said gas delivery system is argon.

* * * * *

UNITED STATES PATENT AND TRADEMARK OFFICE

CERTIFICATE OF CORRECTION

PATENT NO. : 6,660,220 B2
DATED : December 9, 2003
INVENTOR(S) : Bruce R. Forman It is certified that error appears in the above-identified patent and that said Letters Patent is hereby corrected as shown below:

Column 3,
Line 19, after the words “FIG. 8” insert the words -- is a --.

Column 4,
Line 9, change “down grade” to read -- downgrade --.
Line 21, change the words “of slide gate mechanism” to read -- of the slide gate mechanism --.
Line 56, change the words “that fastens feed line 22 slide gate mechanism” to read -- that fastens feed line 22 to the slide gate mechanism --.

Column 8,
Line 52, delete the word “line” before the words “gas feed”.

Column 10,
Line 41, delete the word “as” before the words “using Equation (9)”.

Column 13,
Line 23, change “maintained” to read -- maintain --.

Signed and Sealed this

Twenty-third Day of March, 2004

JON W. DUDAS
*Acting Director of the United States Patent and Trademark Office*